United States Patent [19]

Grothe

[11] Patent Number: 4,631,532

[45] Date of Patent: Dec. 23, 1986

[54] RASTER DISPLAY GENERATOR FOR HYBRID DISPLAY SYSTEM

[75] Inventor: Steven P. Grothe, Glendale, Ariz.

[73] Assignee: Sperry Corporation, New York, N.Y.

[21] Appl. No.: 595,810

[22] Filed: Apr. 2, 1984

[51] Int. Cl.[4] ..... G09G 1/28

[52] U.S. Cl. ..... 340/703; 340/739

[58] Field of Search ..... 340/707, 721, 730, 739, 340/742, 703

[56] References Cited

U.S. PATENT DOCUMENTS

| | | | |
|---|---|---|---|
| 4,189,743 | 2/1980 | Schure et al. | 340/707 X |
| 4,200,866 | 4/1980 | Strathmen | 340/703 |
| 4,231,032 | 10/1980 | Hara et al. | 340/703 |
| 4,254,467 | 3/1981 | Davis et al. | 340/739 X |
| 4,386,345 | 5/1983 | Naveson et al. | 340/742 X |
| 4,425,559 | 1/1984 | Sherman | 340/703 X |
| 4,511,892 | 4/1985 | Grothe | 340/739 |
| 4,555,699 | 11/1985 | Citron et al. | 340/707 |

*Primary Examiner*—Gerald L. Brigance
*Assistant Examiner*—Vincent P. Kovalick
*Attorney, Agent, or Firm*—Howard P. Terry; Arnold L. Albin

[57] ABSTRACT

A color cathode ray tube has raster scan color zones defined by X and Y positional signals derived from a stroke vector generator and stored in a digital memory. Raster scan and stroke vector displays are alternately presented in a hybrid display. The display face of the tube is scanned by a plurality of raster lines and a color transition point is defined by the intersection of a stroke vector with a raster line. The X and Y addresses of the intersection points define the raster line, pixel element, and color at the transition point. The system is arranged so that the X and Y addresses are provided by the stroke vector generator in synchronous relation with the color transition points, and read into memory during the stroke vector refresh period. During the raster scan refresh period, the memory contents are recalled in synchronism with the raster scan, passed through a digital to analog converter, and then applied to the display tube to provide filled-in color zones superposed on the stroke vector display. The reduced memory requirements and controller access time permit dynamically rotating symbology in a synthetic display for aircraft flight instrumentation.

8 Claims, 6 Drawing Figures

RASTER DISPLAY GENERATOR FOR HYBRID DISPLAY SYSTEM

BACKGROUND OF THE INVENTION

1. Field of the Invention

The invention relates to synthetically generated displays for aircraft flight instrumentation, and more particularly to hybrid cathode ray tube displays using digitally generated rasters and stroke vector displays.

2. Description of the Prior Art

Stroke written cathode ray tube (CRT) displays trace the shape of figures to be presented by deflection the electron beam in a manner which connects a successive sequence of strokes, which may be straight or curved. In a raster system the beam is caused to trace a repetitive pattern of parallel scan lines and the information is presented by intensity modulating the electron beam at the appropriate points along each line.

A hybrid display system includes a conventional stroke vector generator and a conventional raster symbol generator which supply sequentially a single CRT with a picture that includes both raster and stroke information. This composite display permits providing rapid update of the character symbology and a colored background with minimal requirements for memory and processing time. In hybrid CRT display systems used in applications such as aircraft instrumentation, real time high speed updates of raster and stroke symbology are required. It is also desirable to produce complex and dynamic raster symbology in addition to stroke symbology, which was not heretofore attainable with conventional raster displays. The raster symbology must be produced in an efficient manner with respect to computation time, quantity of circuitry, and power dissipation.

Digital raster display generators are known in the prior art that utilize permanently wired dedicated raster symbol generation circuitry for generating video signals during the time intervals defined by the digital circuitry generating the raster. See, for example, Display Systems Engineering, Luxenberg & Kuehn, McGraw-Hill, Inc., 1968, pp 267–269. Such systems generally utilize a unique permanently wired symbol generator for each raster symbol or pattern to be displayed. Such systems have the disadvantage of lack of flexibility, since they are not programmable, and they require large amounts of permanently wired circuitry. Consequently, this approach also requires significantly increased volume and power for the electronics. These desiderata are particularly significant in the field of airborne systems.

Other prior art digital display generators use software intensive program techiques. Software intensive techniques have a primary disadvantage of using large amounts of valuable computer time in a real-time system, where processing time is critical.

Two basic methods have been used by prior art software systems. In one approach, as outlined in High Resolution Graphics System, William Burden, Jr., *Popular Computing,* July 1982, pp 116–120, a full-field memory or bit-mapped technique is used, where each resolution element of the display is defined by a group of memory bits in accordance with the individual picture elements on the display screen. The picture is loaded into memory from a computer and the entire memory is read out in synchronism with the digital circuitry generating the raster. An image is produced by specifically setting, for each picture element, the color and intensity desired by writing the appropriate data into the full-field memory. The serial digital memory output words are converted to analog form and are transmitted to the display for each frame refresh. From a hardware standpoint, this approach is unattractive because of the size of the required memory and support circuitry. For example, for displays of nominal size utilizing an adequate color and contrast range, memory capacities of up to one million bits are required. Further, for dynamic symbology, the changing data for each memory element must be repetitively calculated and specifically programmed and stored in memory. This results in a prohibitively high use of processor time and a resulting image whose update rate is unacceptably slow. It may further be appreciated that because of the necessity for rapid readout of the large memory required, a high speed memory system would of necessity be utilized, which tends to be complex, expensive and critical in operation.

A second approach to raster symbol generation is provided in U.S. Pat. No. 4,070,662, Digital Raster Display Generator For Moving Displays, invented by Parm L. Narveson and assigned to the assignee of the present invention. In this approach, the face of the display device is divided into a matrix of cells. A symbol library contains a number of symbols or bit patterns which may be placed into each cell as desired. While reducing the storage requirements for pattern generation, the memory required, along with the support hardware necessary to access and control the memory, makes the cell approach a moderately expensive implementation. Further, the cell approach has not proved to be well suited for the dynamically changing symbology commonly found in flight display applications. Although such movement can be accomplished, it can be done only to a limited extent in practice and may require a significant amount of processor time to calculate the appropriate cell and symbol definitions.

SUMMARY OF THE INVENTION

According to the invention there is provided an apparatus for superposing a raster symbol display and a vector symbol display. The apparatus comprises clock means for providing timing signals for synchronizing the raster symbol display and the vector symbol display. A programmable vector generating means is responsive to the clock means and provides signals representing a stroke vector of predetermined length, origin, and slope, the vector defining regions of predetermined colors. A programmable raster generating means, responsive to the clock means and the vector generating means, provides the raster symbol display sequential to the vector symbol display, the raster display providing at least one region of predetermined color defined by the stroke vector, and comprised of a plurality of raster lines, at least a portion of which are sequentially disposed.

In the preferred embodiment, the programmable raster generating means includes control logic means for receiving positional data provided by the vector generating means. The control logic also is responsive to signals corresponding to ones of a plurality of sequential raster lines and synchronization energization signals for the vector symbol display and the raster symbol display, and selectively provides positional data and sequential raster line signals to an addressing means. Memory means are coupled to the addressing means for storing positional data corresponding to a pixel position on a raster line. A comparator compares the stored positional data in the memory means and sequential signals corresponding to a plurality of sequential picture elements along one of the plurality of sequential raster lines, thereby providing a signal to a digital switch means when the signal corresponding to one of the plurality of sequential picture elements equals signal from the memory means. The digital switch means is synchronized with the raster lines to provide a raster color command signal for each line in the raster symbol display.

DESCRIPTION OF THE PREFERRED EMBODIMENT

In general terms, the face of a display apparatus, such as a cathode ray tube, is sequentially scanned by a stroke vector display and a raster scan display. The stroke vector generator provides positional data and color video data for the raster scan during the stroke period of the refresh cycle. The positional data and color data are stored in digital memory in a raster symbol generator, defining the color of each raster scan line and the picture element at which a color transition occurs. During the raster scan period of the refresh cycle, the data in memory is fetched in synchronism with the raster scan along the X and Y coordinates. By triggering color control logic at the point at intersection of a stroke vector with a raster scan line, zones of color, filled in by the raster scan, are defined by the stroke vector with minimal requirements for data storage and process time while permitting dynamically rotating color symbology. Typically, a raster containing 256 scan lines with 512 picture elements along each line requires a random access memory size of 2304 bits, while a prior art bit-mapped display of the same resolution requires 16,384 bits for a two color display.

Figure 1:
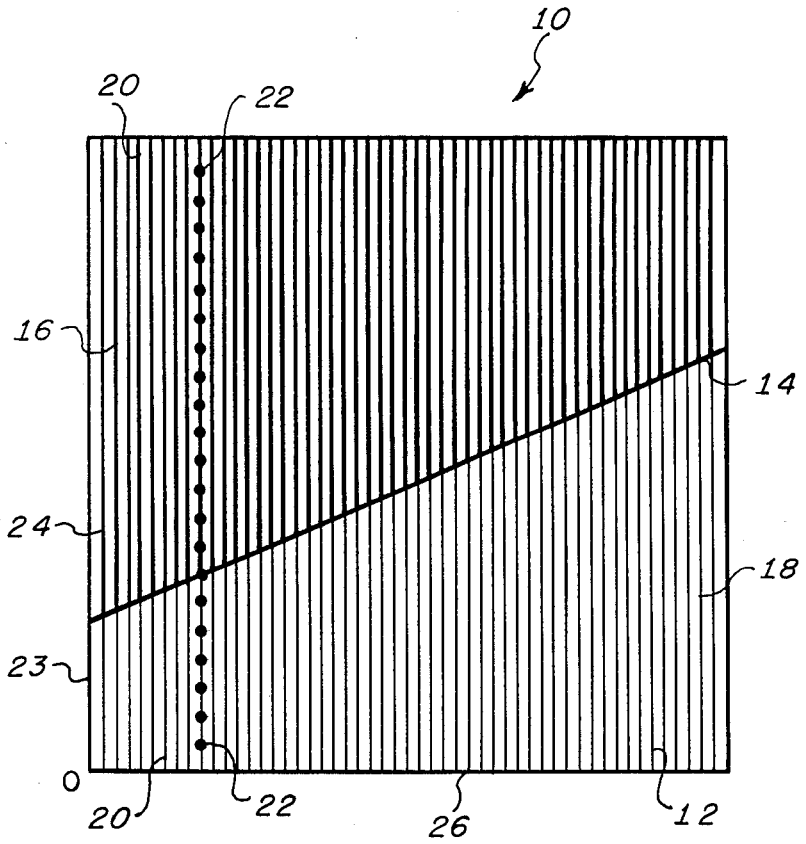
FIG. 1 is a schematic illustration of the display face of a cathode ray tube in accordance with the invention comprising a hybrid stroke vector and raster scan display.

Referring to FIG. 1, a pictorial representation of a display screen generally denoted by reference numeral 10 comprises a display face 12 for diaplaying thereon a multicolor symbology, which may for example be a sky-ground representation, the line 14 denoting the horizon, color zone 16 denoting the sky and color zone 18 denoting the earth. The display face 12 may be, for example, the face of a conventional CRT display but it is appreciated that the invention is applicable to other types of displays as well, such as gas plasma displays, liquid crystal displays or other electrically actuated displays.

A conventional raster generator provides a raster on the display face comprising raster lines 20 made up of individual pixels 22. For clarity of description, the preferred embodiment will be described in terms of a simple non-interlaced raster. It should be understood that these raster lines may be generated sequentially, each raster line containing a number of sequentially generated pixels. A typical display might consist of 256 raster lines, each containing 512 pixels. Greater resolution may be had by increasing the number of lines or the number of pixels per line in a given display.

It will be appreciated that the precepts of the present invention are also applicable to a system having a conventional interlaced raster with the odd raster lines written in one frame and the even raster lines written in the following frame.

Further, while the present invention is described in terms of a rectangular coordinate (X,Y) raster scan display system, it will be appreciated that the principles of the invention could also be applied to displays having other scanning systems. For example, addresses may be specified by polar coordinates for a circular scan, and still other displays use a spiral raster system. In any case the position of the electron beam is known or can be derived so that stored positional information can be fetched and applied to the beam control circuits in accordance with the principles of this invention.

For purposes of describing the invention it will be assumed that the raster generator generates a raster beginning at origin 0 in the lower left hand corner of display face 12 and then draws a raster line 23 vertically by holding the X deflection constant while ramping the Y deflection signal through successive pixels 22 of the scanned line. At the end of the first line, the X deflection is incremented to the second raster line 24, and the Y deflection is initialized to the baseline 26. A second raster line 24 is then drawn vertically by holding the X deflection constant while ramping the Y deflection signal. The screen may be blanked during the retrace portion of the cycle. In this manner, the entire raster pattern is generated. It will be appreciated that the starting point or origin 0 in the lower left hand corner is chosen for convenience and is not to be construed as a limitation of the invention.

With continued reference to FIG. 1, two color zones or intensity shadings, 16 and 18, respectively, may be seen. The desired hue and intensities are provided by control of the color video signal applied to the cathode ray tube. Because of the digital nature of the raster scan, this color choice may be determined at any of the pixels 22 in a raster line. Further, the color choice may be changed at any succeeding raster line.

Line 14 represents a stroke vector as may be drawn by a stroke vector generator. In the present embodiment, the stroke vector delineates the zones of differentiated colors and intensity. It may be seen that "filled in" raster figures may be produced by defining specifically only the outlines of the desired figure and allowing the raster scan to fill the outlined areas with the predetermined color. The digital nature of the vector generator to be described permits defining the figure outline as digital bits or pixels along each raster line. This technique allows the use of the vector generator hardware and software for both stroke and raster symbol generation, in a manner to be described.

Figure 2:
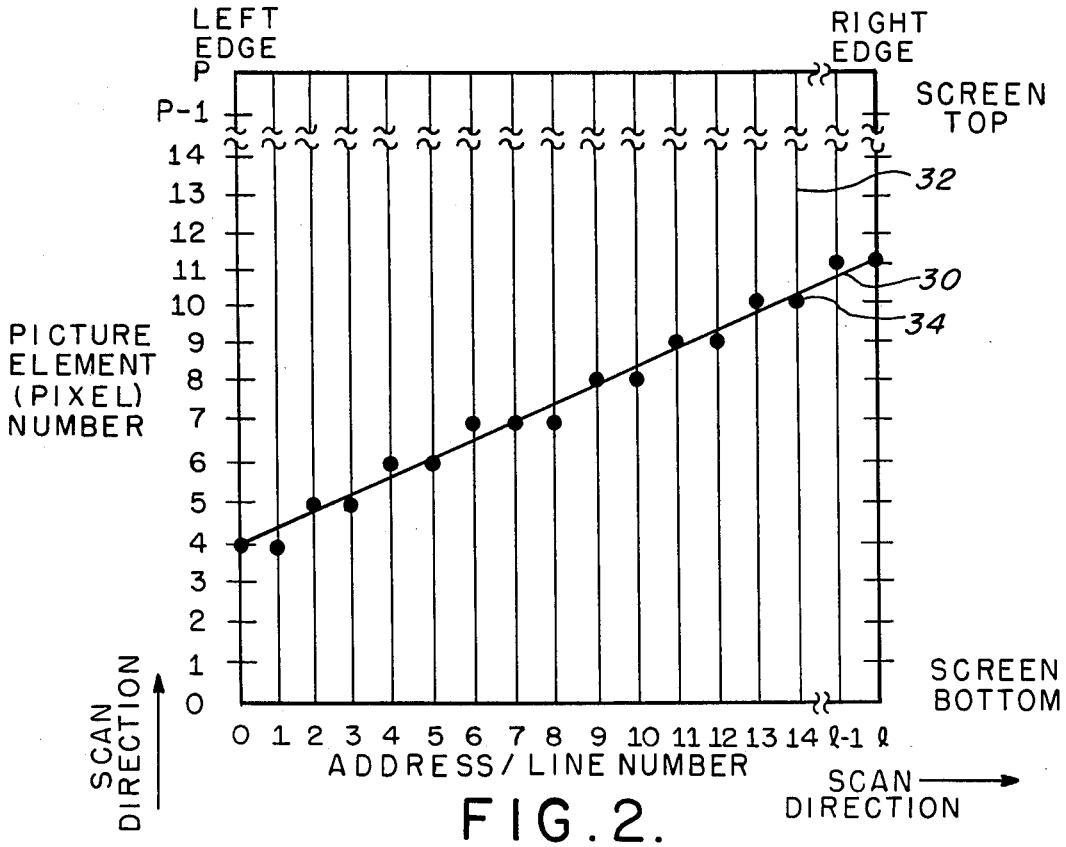
FIG. 2 is a schematic representation of the raster scan showing details of the scan line and pixel structure.

FIG. 2 is an enlarged and exaggerated view of FIG. 1, illustrating the generation of a raster scan pattern which would result in two areas of different color defined by stroke vector 30. As in the previous example, the raster lines are shown drawn from screen bottom to screen top, and sequenced from the origin 0,0 on the left to the right of the screen. In the preferred embodiment, the composite display is refreshed at a 40 Hz rate, with alternating vector stroke and raster scan displays at an 80 Hz rate. For the interlaced scan, the stroke display is thus refreshed at a 80 Hz rate, and individual fields of the raster scan are also displayed at a 80 Hz rate.

By defining the point of intersection between the stroke vector 30 and each raster line 32 where the color is to change, shown here as a dot 34, and predetermining the color at the screen bottom at the start of the line, say line 14, the repetitive raster scan may then be used to fill the areas in the designated color zones. The result is an area of the start color in the region below line 30 and an area of a different color in the region above line 30. For example, in generating artificial sky-ground shading symbology in electronic attitude displays, typically the bottom area will be brown (representing ground) and the top area will be blue (representing sky).

Figure 3:
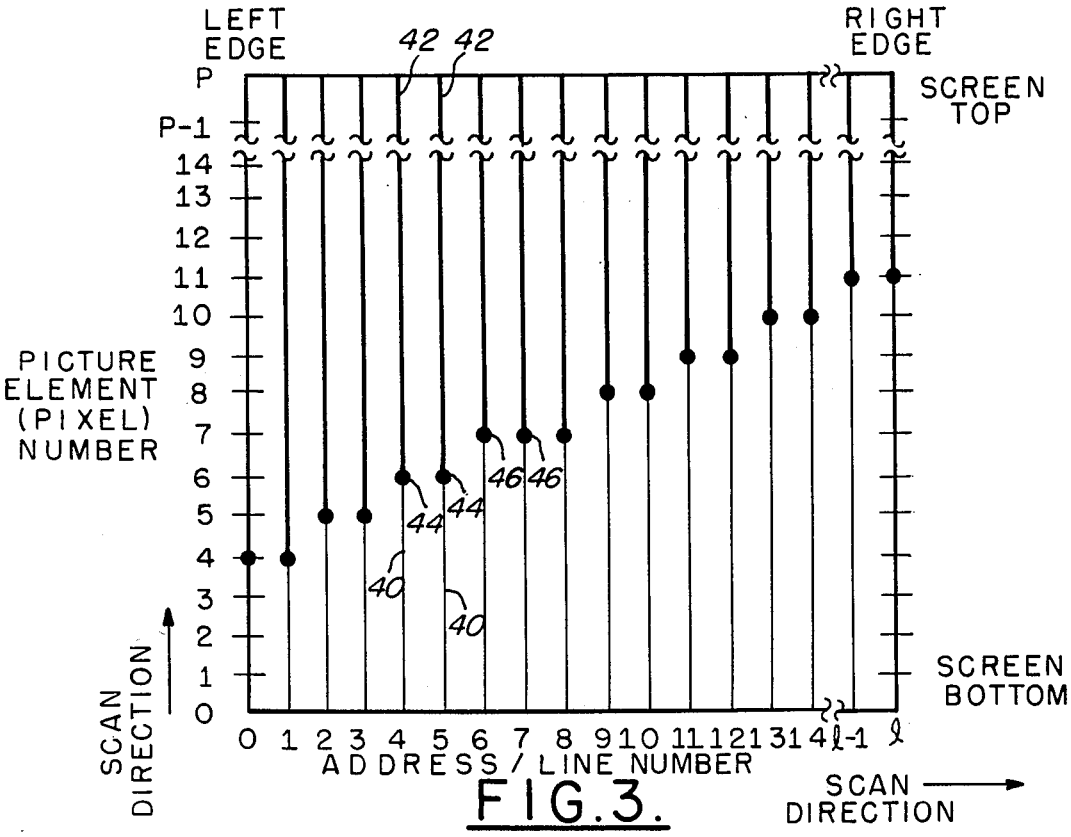
FIG. 3 is a schematic illustration of the display face implemented in accordance with the invention.

FIG. 3 shows the resulting raster scan pattern with a start color shown as the thin lines 40 and a second color as bold lines 42. The "stair stepping" nature of the demarcation between the color zones, shown by bits 44 and 46, is characteristic of raster displays of a digital nature.

Figure 4:
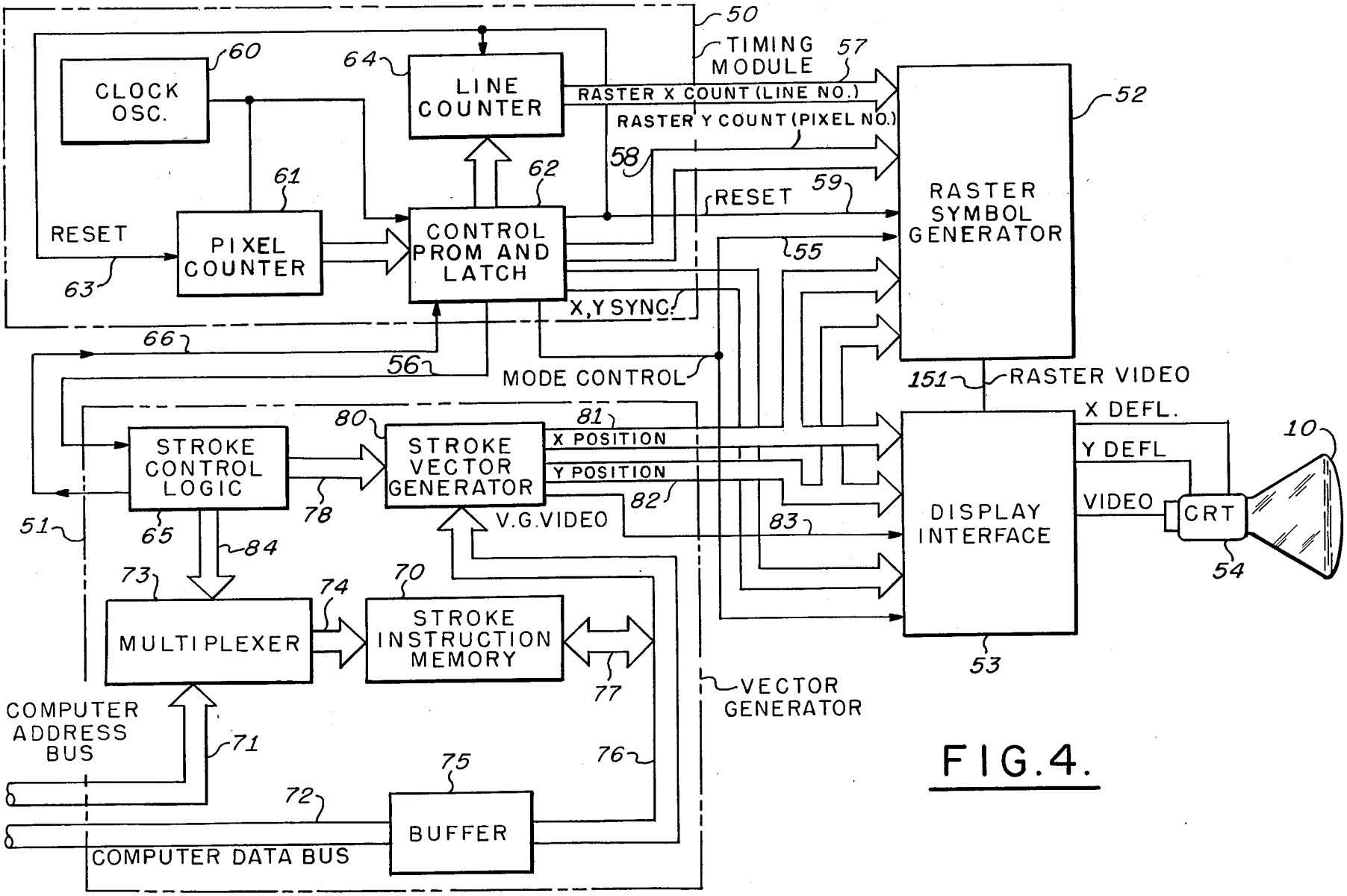
FIG. 4 is a schematic block diagram of the display system utilized in accordance with the invention.

Referring now to FIG. 4, as chematic block diagram of the display system implemented in accordance with the present invention is illustrated. The apparatus includes a clock means or timing module 50, a conventional programmable vector generator 51, a programmable raster symbol generator 52, which is described below, a display interface 53 for converting the digital color and beam position data to analog form, also described below, and a CRT 54 the face 10 of which is illustrated in FIG. 1. The timing module 50 provides horizontal and vertical synchronization pulses for energizing the X (horizontal) and Y (vertical) sweeps for the raster scan on the CRT 54. The timing module also produces a command signal on line 56 to the vector generator 51 to initiate generation of the display format. A mode control signal on line 55 is provided to the raster symbol generator 52 and to display interface block 53 to initiate appropriate display functions during the respective stroke vector portion and raster scan portion of the refresh cycle. Further, the timing module 50 also provides a raster X count on bus 57, representing the sequence of raster lines being generated, a raster Y count on bus 58, representing the sequence of pixels corresponding to raster scan line, and a reset line 59 for establishing the appropriate color conditions at the beginning of a raster scan line. For each one of the plurality of raster scan lines, a complete pixel count will be generated.

The timing module 50 is provided with a clock oscillator 60 for generating regular clock pulses. In the preferred embodiment, this clock preferably operates at 13.1 MHz. However, other clock rates suitable for the required display updating and ancillary circuitry are also suitable. The frequency of the clock oscillator is determined by the resolution of the required X and Y counts, a higher frequency being required for higher resolution systems. The clock pulses are sent to pixel counter 61 and a control PROM (Programmable Read Only Memory) and latch 62 to effect a controller function. Pixel counter 61 is initialized by a signal from PROM 62 on lead 63 at the beginning of each raster scan and counts in synchronism with the pixels being generated to provide the raster Y digital timing signal. A line counter 64, also initialized by the signal on the line 63, is driven by a binary count sequence from control PROM and latch 62 and thereby counts in synchronism with the raster lines being generated to provide a second digital timing signal for the raster X count. Thus, taking pixel counter 61 and line counter 64 together, the timing module generates a pixel number and line number corresponding to the pixel address currently being generated by the conventional raster generator. In terms of the X, Y Cartesian plane, pixel counter 61 generates the Y position and line counter 64 the X position. The control PROM 62 is further programmed such that as the count sequence progresses, control signals to the stroke vector generator 51, raster synbol generator 52, and display interface 53 are generated in the appropriate order and time. A control signal on line 56 is sent to the stroke vector generator 51 to indicate it is to begin generation of the stroke vector display format. When the stroke vector generator has completed its portion of the refresh cycle, it returns a signal on line 66 from stroke control logic block 65 to control PROM 62 which initiates the raster scan portion of the display cycle.

The control PROM and latch 62 is organized to command video modulation at a rate of 80 fields per second where a field is comprised of 128 raster lines with a resolution of 512 pixels per line. A rate of 80 fields per second is required in order to obtain a flicker-free presentation on the CRT face. Preferably, interlaced fields of 128 lines alternate every 12.5 milliseconds to form a complete display format on the face of the CRT at a frame rate of 40 Hz. The timing module 50 determines the field rate by utilizing approximately 6.25 milliseconds to sweep the cathode ray beam across the CRT face during generation of the stroke vector display in each frame, followed by another inverval of 6.25 milliseconds to generate a field of 128 raster lines. These time frames include the time for retrace of the beam, and are followed by a second frame of 6.25 milliseconds for the stroke vector display and 6.25 milliseconds to generate the alternate field of 128 raster lines. When used, the even-odd fields are generated conventionally whereby the first line of the raster is started at the lower left corner of the screen and is initiated at the start of the raster refresh cycle. The odd field, for example, will end at the extreme right end of the next to last raster line 1—1 of FIG. 2. On the next raster refresh cycle the even field will start at the lower left extremity of raster line 1 and end at line 1 at the upper right edge of the screen. An interlace signal, not shown, controls the raster starting position in a conventional manner.

With continued reference to FIG. 4, block 51 shows a conventional vector generator. The vector generator 51 produces horizontal (X position) deflection waveforms and vertical (Y position) deflection waveforms and video (color) control as commanded by instructions stored in a random access memory 70. A conventional computer (not shown) applies digital instruction signals to address bus 71 and data bus 72 in accordance with the display presentation to be generated on the display face 10 of the cathode ray tube 54. During the raster display interval the multiplexer 73 accepts address data on bus 71 and applies the address data to stroke instruction memory 70 via the bus 74. At the beginning of the stroke display interval, data bus 72 from the computer interface applies data to the buffer 75 which is written in to the storage locations in memory 70 via busses 76 and 77 at the address provided on the address bus 71. The instructions are stored sequentially and completely define the picture to be presented. Preferably, the last instruction in the memory will indicate that the display is complete.

When the signal line 56 from timing module 50 initiates an appropriate command to stroke control logic block 65, a control signal is provided to multiplexer 73 through bus 84 to stroke instruction memory 70. By means of control bus 78 to the stroke vector generator 80 the stroke control logic 65 loads instructions through the instruction bus 76 from memory 70. The vector generator 80 uses these instructions to generate the necessary deflection signals on busses 81 and 82 and video bus 83 to present the desired stroke display. Upon completion of the instruction loading, a command is sent on line 66 to control PROM 62 indicating that the stroke vector generator 80 has completed the display update.

Stroke vector generator 80 further comprises a conventional X accumulator, Y accumulator, and video latch, not shown. The vector generator after initialization causes the initial X axis and Y axis positional data and the initial video to be stored in their respective accumulators or latch, respectively. The X-position accumulator updates the stroke vector positional component along the X axis after each digital incrememt of position information, and provides the current X coordinate CRT of beam position on bus 81 to raster symbol generator 52 and display interface 53. Similarly, the accumulator for the Y-position updates the stroke vector Y-position component and thereby provides the current Y-component of position on bus 82 to raster symbol generator 52 and display interface 53. In a like manner V.G. Video Bus 83 provides current video information data to blocks 52 and 53.

Figure 5:
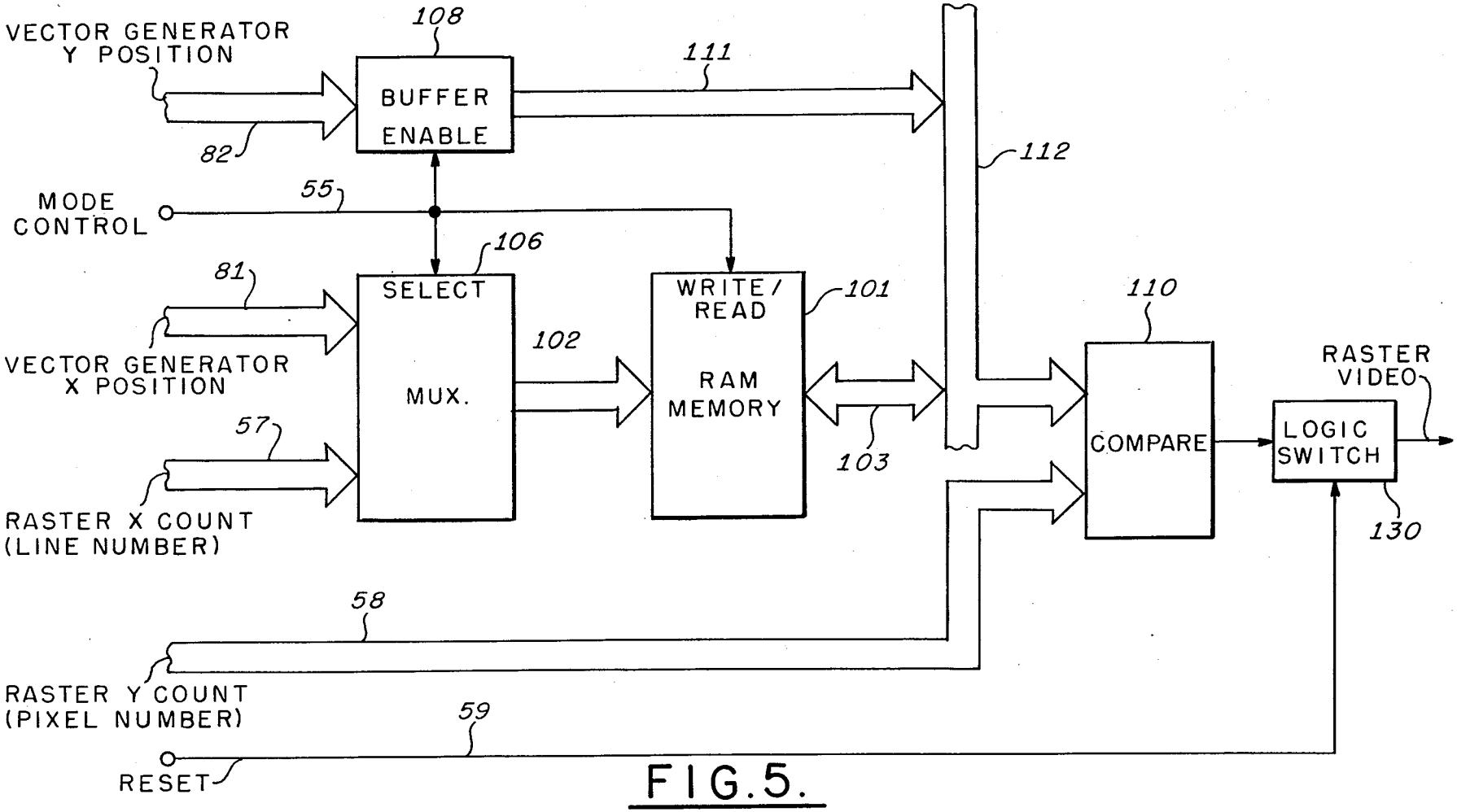
FIG. 5 is a schematic block diagram of a raster symbol generator in accordance with the invention.

Referring now to FIG. 5, a schematic block diagram is shown of the raster symbol generator 52. A memory 101 may conveniently be instrumented as a random access memory (RAM) with read-write capability. The RAM is organized such that there are adequate addressed locations to represent all raster lines and wide enough data fields to provide the desired resolution along each line. For example, in the preferred embodiment a raster containing 256 lines with 512 picture elements along each line requires a RAM size of 256 words×nine bits/word. This provides a location for each of the 256 raster lines and sufficient resolution in each data word (nine bits) to identify any one of the 512 pixels. Thus, each of the 256 storage locations is associated with a particular raster line, and each location permits designation of the particular pixel at which a color change is desired. In a manner to be explained an X-counter and Y-counter of the timing circuitry that synchronizes the sweep of the beam across the display face in raster fashion addresses the storage locations of the memory 101 so as to provide a real time association between the words of the memory 101 and the X and Y positions of the CRT beam. Note that color information perse is not stored in RAM but is determined by associated circuitry to be described.

During the stroke vector portion of the refresh cycle mode control line 55 establishes RAM 101 in the write mode and permits an address 102 from vector generator X-position bus 81, which identifies the raster line number through multiplexer 106, and data from vector generator Y-position bus 82 through buffer 108 and busses 103, 112, and 111 to write data into memory 101 which identifies the pixel at which the color is to change. Thus at each increment or change of vector generator X-position data on bus 81 or vector generator Y-position data on bus 82 the data 103 is written into memory 101 at address 102. Thus, for example, a programmed stroke vector corresponding to the solid diagonal line 14 in FIG. 1 would result in point data represented by the dots 34 in FIG. 2 along the raster lines 0–1. While the preferred embodiment for clarity is illustrated with only a single color change, if more than one color change is required along a given raster line, additional RAM circuitry may be provided.

The readout of the memory 101 is controlled by mode control line 55 so that whenever the raster line scan commands the beam to a predetermined line position, the pixel number at which a color change is desired is read. Thus, when the first vertical raster line 0 is being scanned, then the pixel number desired for a color change on line 0 is available for comparison to the pixel count 0 to p, which corresponds to the vertical position of the beam as the raster line is scanned. When the second vertical raster line 1 is scanned, the color change pixel number for line 1 is read and compared to the actual pixel count 0 to p, and so on through the memory until the final vertical raster line 1 is scanned.

In this manner, following completion of the stroke vector display, the mode control signal on line 55 changes state and causes memory 101 to be operated in the "read" mode. Buffer 108 is disabled, thus preventing any transmission of signal on busses 82 and 111. The raster X count on bus 57, which identifies the raster scan line which is to be displayed, will change only at th end of a line's display interval. The signal on bus 57 is transmitted through multiplexer 106 to provide an address to memory 101. Memory 101 then provides the data located at the selected address on bus 103 to compare block 110, which provides the pixel location at which a desired color change was programmed by the stroke generator signal. A second input to compare block 110 is provided by the raster Y count on bus 58, which identifies the pixel number being displayed. The siganl on bus 58 is reset and increments as each of the raster lines is scanned and when it is equal to the pixel count data on bus 103 compare block 110 provides a control signal to toggle logic switch 130.

Thus, compare block 110 tests whether the pixel currently being generated on bus 58 is equal to the pixel stored at the corresponding raster scan line in memory 101 where a color change is desired. Compare block 110 compares the binary values corresponding to the two pixel positions and when they are numerically equal will output a logical high or logical zero to logic switch 130, as determiend by reset line 59, whose function is described below. The logic switch 130 receives the output of compartor 110 and being a single signal of digital (1 or 0) nature, can define two color states. It will be clear to one skilled in the art that by partially duplicating the memory and control functions described above and processing their raster video outputs in parallel to provide additional output channels, additional color combinations may be realized.

FIG. 5 also shows a reset signal 59 which is applied to logic switch 130. During the blanking interval between the end of one raster scan line and the beginning of the next line the reset signal returns the state of the output of the logic switch 130 to that desired for the start of the next raster line. The origin of the reset signal is the timing module 50. While a reset would typically result in a zero output at logic switch 130, some situations may require a one. For example, when generating sky-ground shading with a stroke vector representing the horizon, a typical reset value would be zero for a brown start color for normal attitudes, representing ground. However, if the aircraft is flying in an inverted attitude, the reset value could be one for a blue start color, representing sky. The value of the start color and the state of the reset signal may be determined by conventional atitude sensor and control logic circuitry, not shown.

Referring again to FIG. 4, the apparatus includes a conventional cathode ray display tube 54 with an electron beam whose position is controlled by X deflection and Y deflection signals applied to corresponding electrodes. A video signal applied to suitable control electrodes determines the hue and intensity of the displayed output. Details of the display interface block 53, which transposes the digital input data to analog values suitable for driving the CRT are shown in FIG. 6, as described below.

Figure 6:
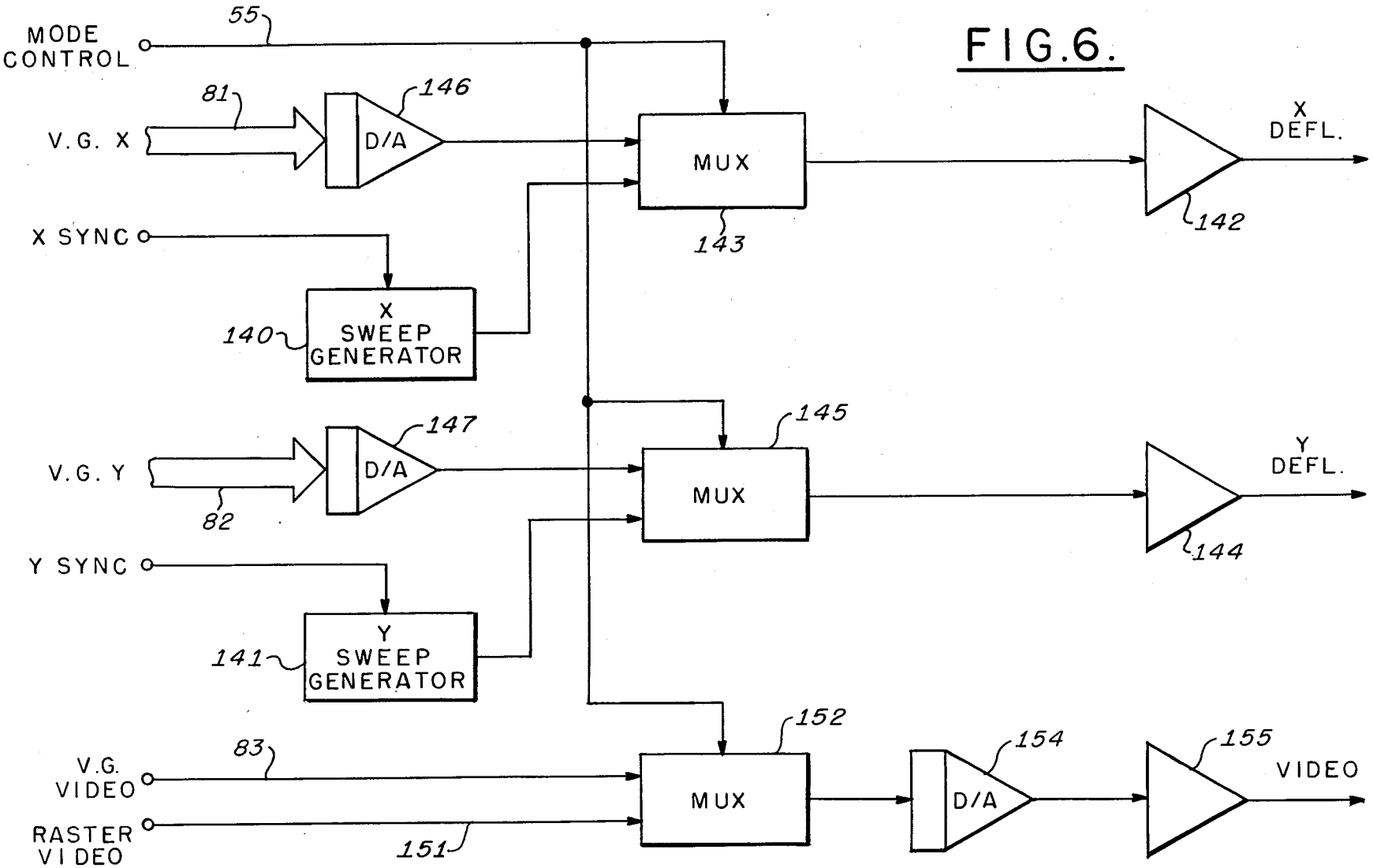
FIG. 6 is a schematic block diagram of a display interface as utilized in accordance with the invention.

Referring now to FIG. 6, the X (horizontal) and Y (vertical) sweeps for the raster of the cathode ray tube 54 are provided by conventional sweep generators 140 and 141 respectively. X Generator 140 feeds X-deflection amplifier 142 through multiplexer 143 and Y generator 141 feeds Y-deflection amplifier 144 through multiplexer 145. The sweep generators 140 and 141 may be comprised of the usual sawtooth waveform X and Y sweep generators for providing the conventional linear raster. During the interval between raster displays, the stroke vector display will be energized.

The raster is synchronized by horizontal and vertical synchronization pulses X sync and Y sync derived from the X counter and Y counter of timing module 50. The synchronization pulses respectively turn on the sweep circuits to scan each raster line in sequence. Such synchronizing circuits are well known in television and display units employing a raster scan. Since the generation of the X and Y raster sweeps from the sweep generators 140 and 141 are synchronized via the horizontal and vertical sync pulses from the control PROM and latch 62, which also controls the raster X count and raster Y count, the digital outputs from the counters respectively correspond to the X-Y position of the beam of the cathode ray tube 54. As discussed previously with respect to FIG. 1, the face 10 of the display screen is considered as comprised of a 256×512 matrix of resolution elements. Thus, the instantaneous binary numbers in the raster X and raster Y count provide X and Y coordinates of the resolution element of the display screen on which the beam is about to impinge.

The outputs of the vector generator 51 representing X-position 81 and Y-position 82 are supplied to the CRT 54 through digital-analog converter 146 for the X axis and converter 147 for the Y axis via respective multiplexers 143 and 145. Selection of either vector generator position output or raster scan output is determined by the mode control signal 55 from control PROM 62. Thus, during the stroke interval, the vector generator position data will be selected, and during the raster scan interval, the sweep generator output will be selected.

In addition to the deflection circuitry, FIG. 6 also shows the circuitry for selecting vector generator or raster video information. Video information from vector generator 51 and raster symbol generator 52 is supplied on lines 83 and 151 respectively to multiplexer 152. During the stroke portion of the refresh cycle, the mode control signal 55 directs vector generator video 83 through multiplexer 152 to digital-analog converter 154 and amplifier 155. On the alternate portion of the refresh cycle, when the raster scan as being displayed, raster video on line 151 is selected by mode control signal 55 and transmitted through multiplexer 152 and digital-analog coverter 154 to amplifier 155. Thus, video from the two sources is sequentially provided to cathode ray tube 54 in synchronism with the corresponding stroke vector and raster scan sweep of the electron beam.

The digital memories used in the preferred embodiment can be a commercially available RAM integrated storage chip such as is used in small or microdigital data processors. The various control functions including storing, fetching and applying digital values as described above can be implemented conveniently by processor or other control logic included in or associated with the CRT display. Such control facilities are well known in digital displays for affecting various operations in synchronism with the display raster, e.g. character generation, cursor location, and stroke vector generation.

The digital to analog convertors may be of any suitable kind which combine binary voltages or currents to produce resultant outputs according to the inputs shown. The amplifiers may be conventional analog amplifiers, such as may be formed by hybrid and integrated circuit techniques.

In operation, the apparatus of FIG. 4 may be applied for providing moving displays of the type that are utilized, for example, in aircraft. On initiation of the stroke display interval by the timing module 50, the stroke control logic 65 is commanded to execute a sequence of stroke instructions which have been stored in stroke instruction memory 70 by means of computer address bus 71 and computer data bus 72. The instructions are loaded into stroke vector generator 80 through busses 76 and 77 and result in the production of digital outputs representing the X-position, Y-position and video (color) for each position of the electron beam of the cathode ray tube 54. The digital X position values on bus 81 and digital Y-position values on bus 82 are converted to corresponding X and Y deflection voltages by the display interface 53 and applied with the converted video information on bus 83 to drive the CRT 54. Simultaneously, X-position data on bus 81 and Y-position data on bus 82 are directed to raster symbol generator 52 to provide the respective address and data for entry into a random access memory in block 32, as shown in FIG. 5. At each increment of change in position of X and Y or change in color of video, the vector generator output is updated. Since the vector output is synchronized with the raster generator, new values are entered into memory corresponding to each raster line. Thus, during the stroke display interval, the random access memory is loaded with the complete picture information for presentation of the raster display as well as the stroke display. Beneficially, it is seen that vector generator 80 and its associated functions (including software) are used for both stroke and raster symbol generation, thereby resulting in substantial economy in circuitry, space, weight, and power consumption.

On completion of the stroke vector portion of the refresh cycle, the timing module 50 initiates the raster scan pattern. During the raster display interval the timing module 50 generates a count sequence to identify sequential raster scan line numbers which are provided on bus 57 and another count sequence to identify the pixel numbers corresponding to the selected raster line on bus 58. These two counts are then entered into the raster symbol generator 52.

Referring now to FIG. 5, the memory 101 in block 52 is now operated in the read mode and provides an output corresponding to an address entered by the raster X count (scan line number), thereby enabling retrieval of the corresponding pixel data previously entered therein. At the same time, the output of RAM is compared with the raster Y count which is sequencing through the range of 512 pixels per scan line. When the pixel numbers read from memory 101 and raster Y count bus 58 are equal, a raster video command is produced by compare equal block 11 energizing logic switch 130. The raster video output is produced by raster symbol generator 52 in synchronism with X-deflection and Y-deflection raster sweep waveforms generated by display interface 53. The digital raster video is then converted to analog video in display interface 53 for determining the color of the corresponding raster scan lines during the respective phases of the scan interval. Thus, both the stroke vector and raster scan video may be independently predetermined.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. Apparatus for superposing a raster symbol diaplay and a vector symbol diaplay on a cathode ray tube viewing screen, comprising:

clock means for providing timing signals for said raster symbol display and said vector symbol display, said clock means comprising:

(a) a clock pulse source, for generating regular timing pulses at a predetermined repetition rate, (b) first digital counting means responsive to said regular clock pulses for providing a first digital count signal in accordance therewith, (c) logic means responsive to said first digital count signal for providing digital signals for synchronizing displacements of a plurality of sequentially disposed raster lines comprising said raster symbol display along first and second display axes, and further providing said first digital count signal to programmable raster symbol generating means, and (d) second digital counting means coupled to receive signals derived from said logic means for providing a second digital count signal representative of displacements along one of said display axes to said programmable raster symbol generating means, said first digital count signal and said second digital count signal having relative output frequencies in accordance with a predetermined ratio, programmable vector generating means responsive to said clock means and coupled to said raster symbol generating means for providing positional signals representing a stroke vector of predetermined length, origin, and slope, said vector comprising a plurality of sequential picture elements defining positional and color data for regions of predetermined colors, said programmable raster symbol generating means including memory means for storing an incremental location corresponding to a color change of ones of said raster lines, thereby providing at least one of said regions of predetermined colors defined by said stroke vector and said plurality of raster lines, and display interface means coupled to said raster symbol generating means and said vector generating means for alternately providing raster information and stroke vector information to said cathode ray tube viewing screen.

2. The aparatus as set forth in claim 1, wherein:

said first digital counting means is comprised of first sequential signals corresponding to a plurality of sequential picture elements along at least one of said plurality of raster lines, said logic means further comprises:

(a) means for receiving said first sequential signals and providing corresponding digital signals to said programmable raster generating means, and (b) means for providing said synchronizing digital signals to said vector symbol display and said raster symbol display, and said second digital counting means is responsive to said logic means for providing second sequential signals corresponding respectively to ones of said plurality of raster lines.

3. Apparatus as set forth in claim 2, said programmable raster symbol generating means further comprising:

control logic means for receiving said positional signals, said second sequential signals, and said synchronization signals, and for selectively providing digital signals corresponding thereto, addressing means, coupled to said control logic means, for receiving said digital signals, memory means, coupled to said addressing means and responsive to said control logic means, for storing at least a portion of said positional signals, comparison logic means, responsive to said memory means and said first sequential signals, for providing a command signal when one of said first sequential signals corresponds to a predetermined one of said positional signals from said memory means, said command signal defining a predetermined color of one of said raster lines, and for inhibiting said command signal in the absence of said correspondence, and digital switch means responsive to said command signal for providing a raster color command signal in accordance with said predetermined color to said raster symbol display.

4. Apparatus as set forth in claim 3, said programmable vector generating means further comprising:

memory means, responsive to a source of digital data, for storing stroke vector instructions for said programmable vector generating means in digital form, addressing means, coupled to said memory means, for addressing said digital instructions, stroke vector generating means, responsive to said memory means, for providing said positional signals corresponding to said stroke vector instructions along said first and second display axes, respectively, and for providing a vector color command signal, and control logic means, responsive to said clock means and coupled to said stroke vector generating means, for initiating and terminating the operation of said stroke vector generating means.

5. The apparatus as set forth in claim 4, in which said cathode ray tube comprises an electron beam, X and Y beam deflection means for positioning said beam along said first and second axes, respectively, and color writing means for writing predetermined colors on said viewing screen.

6. The apparatus as set forth in claim 5, further comprising display interface means for receiving said positonal signals corresponding to said first and second display axes, said synchronization signals, and said color command signals from said vector generating means and said raster generating means; and for providing corresonsding X and Y analog positional signals to said X and Y beam deflection means, respectively and said color command signals to said color writing means.

7. The apparatus as set forth in claim 6, in which said X axis is orthogonal to said Y axis, said first sequential signals correspond to the density of picture elements along a raster scan line, and said second sequential signals correspond to the density of raster scan lines.

8. A hybrid display system, comprising:

a cathode ray tube having an electron beam, a display face and first and second display axes, and responsive to beam positional signals for deflecting said beam along first and second axes on said display face, programmable stroke vector display generating means responsive to a source of digital instructions for providing said positional signals and color command signals corresponding to stroke vector commands, means for providing a plurality of raster lines on said display face, programmable raster symbol generating means coupled to said vector display generating means for receiving said positional signals, said raster symbol generating means further comprising means for deriving raster color zone signals from said positional signals, said means including memory means responsive to said positional signals for storing instructions in digital form corresponding to said raster color zone signals at predetermined picture element locations along selected ones of said plurality of raster scan lines, and addressing means, coupled to said memory means and said stroke vector display generating means, for addressing said digital instructions, clock means for providing raster count timing signals to said raster symbol generating means corresponding to a sequential display of said plurality of raster scan lines along said first axis on said display face, and for providing pixel count timing signals corresponding to a sequential display of picture elements along ones of said plurality of raster scan lines along said second axis, wherein said raster count signals are in synchronous relationship to said pixel count signals, means for comparing said raster count timing signals and said pixel count timing signals with said digital instructions, so that a predetermined color raster command signal is provided when said raster count and said pixel count timing signals correspond to a predetermined picture element location along said selected ones of said raster scan lines, synchronization means for sequentially and alternately displaying said stroke vector and said raster scan lines on said cathode ray tube display face, and means for energizing said cathode ray tube by said raster color command signal, whereby said raster scan lines provide a color zone corresponding to said color zone signals superposed on said stroke vector.

* * * * *